US005922463A

United States Patent [19]

Baris et al.

[11] Patent Number: 5,922,463

[45] **Date of Patent: *Jul. 13, 1999**

[54] MONOFILAMENTS WITH IMPROVED WEAVABILITY AND FABRICS PRODUCED THEREWITH

[75] Inventors: Halim Baris, Lucerne, Switzerland; Etienne Fleury, Irigny, France

[73] Assignee: Rhodia Filtec AG, Emmenbruecke, Switzerland

[ * ] Notice: This patent is subject to a terminal disclaimer.

[21] Appl. No.: 08/819,524

[22] Filed: Mar. 17, 1997

Related U.S. Application Data

[63] Continuation-in-part of application No. 08/411,626, Mar. 31, 1995, abandoned.

[30] Foreign Application Priority Data

Aug. 6, 1993 [CH] Switzerland ..... 2355/93

[51] Int. Cl.[6] ..... B32B 27/34; C08F 283/00; C08F 20/00; C08G 77/04

[52] U.S. Cl. ..... 428/395; 428/391; 525/474; 525/446; 528/26

[58] Field of Search ..... 428/395, 391, 428/373; 525/474, 446; 528/26

[56] References Cited

U.S. PATENT DOCUMENTS

| | | | |
|---|---|---|---|
| 4,640,962 | 2/1987 | Ostrozynski et al. | 428/391 |
| 4,758,637 | 7/1988 | Merrifield et al. | 428/391 |
| 4,766,181 | 8/1988 | Ostrozynski et al. | 428/395 |
| 5,132,392 | 7/1992 | De Young et al. | 528/372 |

FOREIGN PATENT DOCUMENTS 0269023 6/1988 European Pat. Off. .

*Primary Examiner*—Newton Edwards
*Attorney, Agent, or Firm*—Michael J. Striker

[57] ABSTRACT

The monofilament for precision woven fabrics is made of a polyethylene terephthalate/polydialkyl siloxane copolymer having a silicon content from 0.05 to 2.0 percent by weight, a polyethylene terephthalate proportion of at least 85% by weight, a diameter from 0.01 to 0.1 mm, an elongation at break of less than 30%, a strength of at least 45 cN/tex, a modulus of elasticity at 5% extension greater than 500 cN/tex and a fibrillation characterizing parameter from 0.0 to 0.5.

4 Claims, 2 Drawing Sheets

MONOFILAMENTS WITH IMPROVED WEAVABILITY AND FABRICS PRODUCED THEREWITH

This is a continuation-in-part of U.S. patent application Ser. No. 08/411,626, filed Mar. 31, 1995, and now abandoned. Reference is also made here to copending application Ser. No. 08/392,926, filed Feb. 27, 1995, for soil-repellent and abrasion-resistant monofilament made with silicon-modified polyethylene terephthalate.

BACKGROUND OF THE INVENTION

The invention relates to a monofilament with a diameter of less than 0.1 mm formed of a polyethylene terephthalate/polydialkyl siloxane, in which the proportion of polyethylene terephthalate is at least 85 percent by weight, for the production of woven fabrics, and to a method of making a woven fabric from this monofilament.

When weaving densely woven fabrics from fine monofilaments of polyester, the surface of the monofilament will often peel away or split off. The peeled off residue is deposited on the weaving reeds. This frequently renders weaving impossible or excessively shortens the cleaning cycle for the weaving machine. Peeling also causes a deterioration in the quality of the woven fabric, particularly due to clogging of the fabric openings. This phenomenon is due to poor abrasion resistance in the polyester monofilaments, for instance, compared with polyamide monofilaments.

Fine monofilaments are understood in the present context to mean monofilaments with a diameter in the range of 0.01 to 0.1 mm.

There have been many attempts to improve the weavability of fine monofilaments of polyester. For example, attempts have been made avoid the disadvantage of insufficient weavability by producing a core/sheath monofilament with a polyamide sheath. However, this solution increases the cost of producing the monofilament and is accordingly uneconomical.

Also known are monofilaments with a fine diameter, so-called bicomponent threads, whose core is made from a different copolyester than the sheath (EP-A-0 399 053). In this way, relatively fine polyester monofilaments which can be woven virtually without abrasion have been successfully produced by chemically modifying the sheath. However, as in the above example, the elevated operating costs in manufacturing the core/sheath threads is also disadvantageous.

It is also known (EP-A-0 269 023) to produce silicon-modified polyesters in the form of matrix fibers. In so doing, the silicon matrix serves as protection against mechanical loading of the fiber during weaving and other textile processes. Coatings in all forms are disadvantageous for fine monofilaments, because peeling and increased splitting or fibrillation render weaving impossible. Moreover, the process of coating monofilaments is costly.

SUMMARY OF THE INVENTION

The object of the present invention is to improve the weavability of fine polyester monofilaments in the warp and weft directions, to eliminate peeling, splitting and abrasion during weaving, and to prolong weaving running times by reducing cleaning time.

According to the invention, this object is attained in a monofilament made from a polyethylene terephthalate/polydialkyl siloxane copolymer having a polyethylene terephthalate proportion of at least 85% by weight. This monofilament has an elongation at break of less than 30%, a tenacity of at least 45 cN/tex and, at the same time, a modulus of elasticity at 5% extension of greater than 500 cN/tex.

The polyethylene terephthalate/polydialkyl siloxane copolymer used to make the monofilaments according to the invention is made by a process described in International Published Patent Application, WO 93/18086, published Sep. 16, 1993, Rhône-Poulenc, applicant; Etienne Fleury, et al, inventors. The process of making the copolymers used to make the monofilament according to the invention, which is described in this reference, is incorporated here by reference. This two-step process includes transesterification or esterification at a temperature from 180° to 260 ° C. in a mixture of monomers including ethylene terephthalate, ethylene glycol and a siloxane compound, advantageously in the presence of a transesterification or esterification catalyst, and a second polycondensation step, preferably performed under an inert atmosphere at 150° to 260° C. and from 0.1 mbar to 2 mbar in the presence of a polycondensation catalyst.

In a preferred embodiment the polyethylene terephthalate/polydialkyl siloxane copolymer has the following formula I $$R_2—Si(CH_3)_2—[O—Si(CH_3)_2]n—O—Si(CH_3)_2—R_2 \quad (I),$$

wherein n =150 and $R_2$ =HO—$(CH_2)_3$—.

The polyethylene terephthalate/polydialkyl siloxane copolymers used to make the monofilament are preferably the copolymers containing the units I and II of the structural formulae disclosed on page 2 of WO 93/18086.

Surprisingly, it has been shown that, when these comonomers of functionalized polysiloxanes are included in the polyester chain, the weavability of the monofilaments with a diameter of less than 0.1 mm is considerably improved. There is no apparent peeling in fine monofilaments with a diameter between 0.01 to 0.1 mm. Accordingly, frequent weaving cleaning cycles can now be appreciably reduced and there is no clogging of fabric openings.

Copolyesters which are modified with functionalized polydialkyl siloxanes either in granulated form already during production or by addition immediately prior to extrusion and which contain about 0.5 percent by weight silicon in the finished monofilament have proven particularly suitable. Also polysiloxanes, such as those provided as starting material for use according to the invention, are known from EP-A-0 269 023. These known chemically modified polymers are used for producing matrix fibers, but are not suitable in their present form for precision woven fabrics for filter media and silk screening.

Monofilaments according to the invention having a monofilament-monofilament coefficient of friction $\mu<0.30$ and ceramic-monofilament coefficient of friction $\mu<0.50$ are particularly preferred and have the advantage that they improve weavability of the monofilament on commercially available weaving machines. The monofilament-monofilament coefficient of friction is the dimensionless coefficient of friction obtained, when the force of friction between monofilaments is measured and the results interpreted according to the normal laws of friction. Similarly the ceramic-monofilament coefficient of friction is the dimensionless coefficient of friction obtained, when the force of friction between a monofilament according to the invention and ceramic material is measured.

The monofilament according to the invention also preferably has a residual tensile strength >85% at an extension of 18% with reference to knot-free monofilament. The knot strength of the monofilament is substantially improved in this embodiment.

The Si content is advisably 0.05 to 2.0 percent by weight, particularly 0.05 to 1.5 percent by weight, and preferably 0.05 to 1.0 percent by weight, with reference to the weight of the monofilament.

A testing device was employed under simulated weaving conditions to determine abrasion and peeling.

The abrasion of the polyester monofilament modified according to the invention is just barely visible on the weaving reed of the testing device used, but is still not weighable. It is particularly advantageous that interim cleaning of the weaving reeds during manufacture of a woven fabric is not strictly necessary and that the cleaning cycle is extended. Accordingly, the quality of the woven fabric is also considerably improved.

The polyester/polydialkyl siloxane monofilaments according to the invention are particularly suitable for use in the manufacture of woven fabrics for filter media, sieves and screens for silk screening.

The monofilaments are melt-spun from the polyester/polydialkyl siloxane copolymer by conventional melt spinning methods in all cases. The monofilaments are produced by forcing a copolymer melt through a conventional spinning jet or spinning device, stretching and cooling the monofilaments and winding them on a bobbin. In all cases, the monofilaments of the invention may be made from a melt at about 290° C. at a spinning speed of about 600 m/min with a polymer throughput of from about 23 g/min to about 27 g/min and by stretching them with a stretching apparatus to a residual elongation of from about 20±2% to about 28±2%.

BRIEF DESCRIPTION OF THE DRAWING

The objects, features and advantages of the invention will now be illustrated in more detail with the aid of the following description of the preferred embodiments and examples, with reference to the accompanying figures in which.

DESCRIPTION OF THE PREFERRED EMBODIMENTS

The invention is described more fully by examples.

The selected model titer for the examples of the monofilament according to the invention was 13 fl and the copolyester of polyethylene terephthalate (PET) and polydimethyl siloxane (PDMS) was selected as the copolymer from which the monofilament was spun. This titer corresponds to a diameter of 0.034 mm in all examples of the PET/PDMS monofilaments. The following spinning conditions were used in all examples:

melting temperature: 290° C.

bobbin speed: 600 m/min polymer throughput: 23 g/min and 27 g/min

In addition, the exemplary monofilaments were stretched on a stretching installation to a residual elongation of 28+/−2% and 20+/−2% in one step at about 200° C., and at about 100 m/min.

The monofilament characteristics for the exemplary monofilaments were measured according to well known standard methods for measuring monofilament properties. For example, the tenacity of the monofilaments is measured according the German industry standard methods described in DIN 53 815 and DIN 53 816. The % elongation and the modulus were also measured according to German industry standard methods set forth in DIN publications. The most important monofilament characteristics, namely the % elongation, the tenacity and the modulus, are compiled in Table I hereinbelow.

TABLE I

ELONGATION, TENACITY AND MODULUS FOR MONOFILAMENTS MADE FROM PET AND PET/PDMS COPOLYMERS ACCORDING TO THE INVENTION

| COPOLYMER | Si % | Elongation [%] | Tenacity [cN/tex] | Modulus at 5% elongation [cN/tex] |
|---|---|---|---|---|
| PET | 0 | 27 | 55 | 695 |
| PET | 0 | 19 | 62 | 860 |
| PET/PDMS | 0.7 | 29 | 56 | 685 |
| PET/PDMS | 0.7 | 19 | 59 | 840 |

Figure 1:
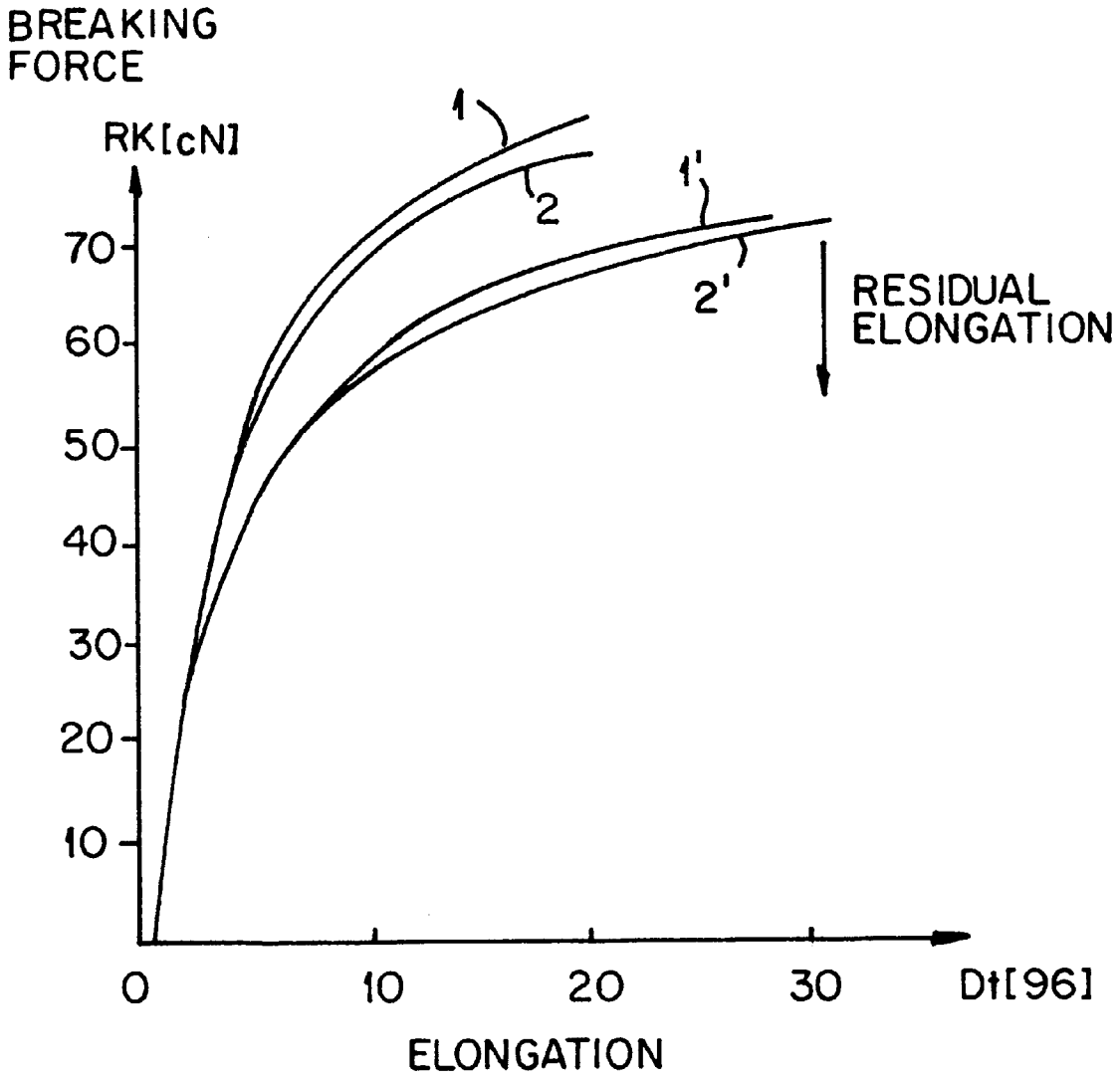
FIG. 1 is a stress-strain diagram comparing monofilaments made with pure PET copolymer with those made with PET/PDMS copolymer.

As will be seen from the stress-strain diagram shown in FIG. 1, roughly identical mechanical characteristics are obtained at a predetermined residual elongation for polyester/polydimethyl siloxane 2, 2' compared with pure polyethylene terephthalate 1, 1'. All stretched threads had shrinkage values on boiling of 5%–6%.

Figure 2:
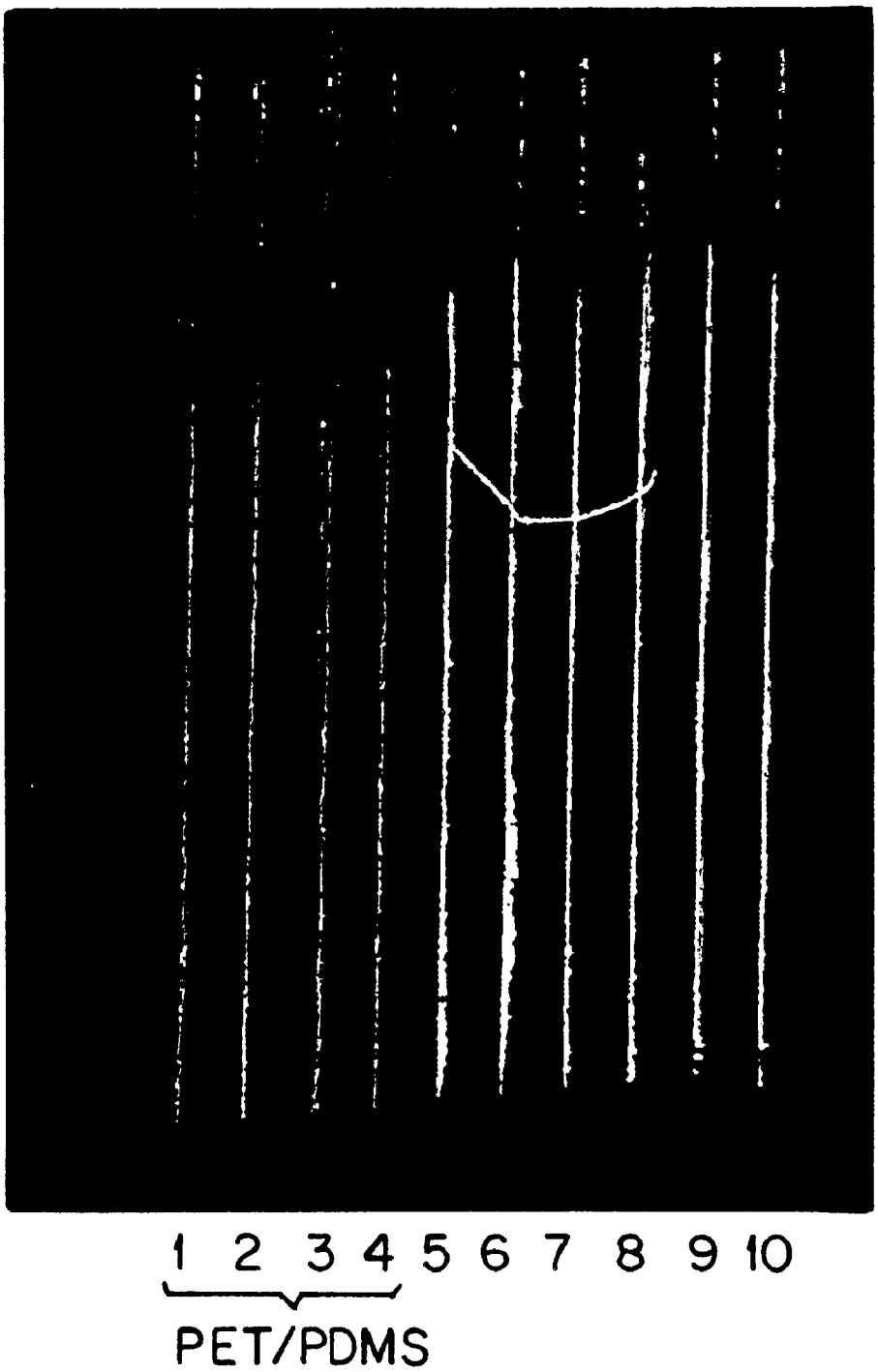
FIG. 2 is a photograph of a weaving reed of the testing device (after test) comparing fibrillation obtained with monofilaments made with pure PET copolymer with fibrillation obtaind with monofilaments made with PET/PDMS copolymer.

FIG. 2 shows the results of a weaving test in a photograph of the weaving reed used. The threads at positions labeled 1 to 4 show monofilaments according to the invention which exhibit very little abrasion and peeling during the weaving test. The threads at positions labeled 5–10 in FIG. 2 are prior art PET monofilaments shown for comparison tests which do not contain PDMS. These prior art monofilaments exhibit substantial abrasion or peeling on the weaving reed of the testing device after testing. It follows that the monofilament according to the invention has a substantially improved weavability and longer operating cycles.

The coefficients of friction were determined by the rope friction equation. The coefficients of friction were measured for 2 minutes in an apparatus manufactured by Rothschild Messinstrumente, Zurich. In this apparatus a monofilament is slung around an object for obtaining the friction coefficient, f, of the monofilament on the object. The tension in the monofilament before the object, t1, and after the object, t2, are measured by an electronic tension meter in the apparatus. The arc angle of contact, α, of the monofilament on the object is also measured. This apparatus directly calculates the friction coefficient, f, as $$f=\{ln(t1)-ln(t2)\}/\alpha$$

and displays the friction coefficient directly on the meter. Detailed procedures are outlined in Preprint Nr. 14VS01 M available from Rhône-Poulenc Viscossuise S. A., CH-6020 Emmenbrütcke, Switzerland, which includes a discussion of the method of using the apparatus and the accuracy of the results. For determining the ceramic-monofilament coefficients of friction, a ceramic pin was used as the object in this device has a diameter of 20 mm and a roughness of 0.45.

The monofilament-monofilament coefficient of friction and the monofilament-ceramic coefficient of friction for monofilaments according to the invention made from the PET/PDMS copolymers are compared with the coefficients of friction for prior art PET monofilaments in Table II. These coefficients of friction were measured by the above-described rope friction method.

TABLE II

Coefficients of Friction for Monofilaments according to the Invention and the Prior Art

| Copolymer | Si % | Monofilament/ monofilament | Ceramic/ monofilament |
|---|---|---|---|
| PET (prior art) | 0 | 0.33 | 0.53 |
| PET/PDMS (invention) | 0.7 | 0.29 | 0.48 |

Surprisingly, the coefficients of friction of the PET/PDMS monofilament are approximately 10% lower for both the monofilament-monofilament coefficient of friction and the monofilament-ceramic coefficient of friction.

The knot residual breaking strength of polyester in comparison to polyester/PDMS, expressed in percent, is shown in Table III.

TABLE III

KNOT RESIDUAL BREAKING STRENGTH at Predetermined Elongation (Dt in %)

| Copolymer | Si % | Dt = 28% | Dt = 18% |
|---|---|---|---|
| PET | 0 | 90 | 81 |
| PET/PDMS | 0.7 | 91 | 89 |

Although no substantial difference between the invention and prior art examples was found at an elongation of Dt=28%, the variation at Dt=18% surprisingly shows a lower tensile strength loss for the monofilament of the invention.

The following original method (fibrillation test) was used to further determine weavability. To determine the fibrillation of monofilaments for screen fabrics, a bundle of identical monofilaments is beaten against a standardized solid body for 10 minutes at a frequency of 2000 to 3200 rpm. The results of the fibrillation test are compiled in Table IV using the following notation:

Fibrillation, characterizing parameter 0.0–0.5 no fibrillation or very slight fibrillation 0.5–1.5 slight fibrillation 1.5–3.5 medium-high to high fibrillation >4.5 very high damage The results of the fibrillation test are compiled in the following table IV.

TABLE IV

COMPARISON OF FIBRILLATION RESULTS FOR EXAMPLES OF PRIOR ART MONOFILAMENTS AND MONOFILAMENTS OF THE INVENTION

| | | Residual elongation = 28% | | Residual elongation = 20% | |
|---|---|---|---|---|---|
| Copolymer | Si % | 2000/10* | 2000/15* | 2000/10* | 2000/15* |
| PET | 0 | 1.0 | 1.5 | 1.3 | 2.2 |
| PET/PDMS | 0.7 | 0.0 | 0.1 | 0.3 | 0.4 |

*By 2000/10 is meant: 2000 rpm for a duration of 10 minutes.

It follows that the monofilament according to the invention has a substantially lower fibrillation which was also shown in the weavability test results shown in the photograph in FIG. 2.

Moreover, the PET/PDMS monofilaments produced according to the invention are less stiff than known monofilaments.

By using the process according to the invention, it is possible for the first time to eliminate peeling of homogeneous polyester monofilaments with a diameter of less than 0.1 mm and a residual elongation of less than 30%.

While the invention has been illustrated and described as embodied in monofilaments with improved weavability and fabrics produced therefrom, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

What is claimed is:

1. A monofilament for a precision woven fabric, wherein said monofilament consists of a polyethylene terephthalate/polydialkylsiloxane copolymer having a silicon content from 0.05 to 2.0 percent by weight and a polyethylene terephthalate proportion of at least 85% by weight, and said monofilament has a diameter of less than 0.1 mm, an elongation at break of less than 30%, a tenacity of at least 45 cN/tex, a modulus of elasticity of greater than 500 cN/tex at 5% extension and a fibrillation characterizing parameter of 0.0 to 0.5, so that fibrillation of the monofilaments during weaving is substantially reduced in comparison to monofilaments made from a polyethylene terephthalate copolymer without polydialkylsiloxane.

2. The monofilament as defined by claim 1 and made by a process comprising the steps of melt-spinning from a melt of said copolymer at about 290° C. at a spinning speed of about 600 m/min with a throughput of from about 23 g/min to about 27 g/min and stretching to a residual elongation of from about 20±2% to about 28±2%.

3. The monofilament as defined in claim 1, wherein said polyethylene terephthalate/polydialkylsiloxane copolymer is a polyethylene terephthalate/polydimethylsiloxane (PET/PDMS) copolymer.

4. The monofilament as defined in claim 3 and having substantially no fibrillation after being beaten against a solid body at a frequency of 2000 rpm for fifteen minutes.

* * * * *